US005238804A

United States Patent [19]

Maskasky et al.

[11] Patent Number: 5,238,804

[45] Date of Patent: Aug. 24, 1993

[54] HIGH BROMIDE CHLORIDE CONTAINING SILVER IODOHALIDE EMULSIONS EXHIBITING AN INCREASED PROPORTION OF IODIDE

[75] Inventors: Joe E. Maskasky; Carlos A. Reyes, both of Rochester; Martin McMillan, Pittsford, all of N.Y.

[73] Assignee: Eastman Kodak Company, Rochester, N.Y.

[21] Appl. No.: 649,638

[22] Filed: Feb. 1, 1991

[51] Int. Cl.[5] ..... G03C 1/005

[52] U.S. Cl. ..... 430/567; 430/569

[58] Field of Search ..... 430/567, 569

[56] References Cited

U.S. PATENT DOCUMENTS 4,184,878 1/1980 Maternaghan ..... 430/567
4,519,549 5/1986 Matsuzaka et al. ..... 430/567

FOREIGN PATENT DOCUMENTS 505012 8/1930 Fed. Rep. of Germany .
522766 4/1931 Fed. Rep. of Germany .
2328868 6/1973 Fed. Rep. of Germany .

OTHER PUBLICATIONS

Phillips, "An Introduction to Crystallography", 4th ed., Longman 1971 reprinted 1981, pp. 8-9, 51-61.
Castellan, "Physical Chemistry" Addison-Wesley Publishing Co. 1964, pp. 291-317.
James, *The Theory of Photographic Process,* 4th Ed., Macmillan (1977), pp. 1-5.

*Primary Examiner*—Charles L. Bowers, Jr.
*Assistant Examiner*—Thorl Chea
*Attorney, Agent, or Firm*—Peter C. Cody

[57] ABSTRACT

A photographic silver halide emulsion comprised of a silver halide grain structure containing chloride, bromide and iodide ions in which the molar ratio of bromide ions to chloride ions ranges from 9:1 to 1:1 and the proportion of iodide has been increased.

5 Claims, 3 Drawing Sheets

HIGH BROMIDE CHLORIDE CONTAINING SILVER IODOHALIDE EMULSIONS EXHIBITING AN INCREASED PROPORTION OF IODIDE

FIELD OF THE INVENTION

The invention is directed to silver halide photography. More specifically, the invention is directed to a novel silver halide emulsion for use in photography.

BACKGROUND OF THE INVENTION

Photographic silver halide emulsions contain radiation-sensitive microcrystals, commonly referred to as grains. Radiation-sensitive grains which consist essentially of silver iodide, bromide or chloride, with no other halide being present are each known. Radiation-sensitive grains containing mixtures of halides in their crystal structure are also known. However, the range of halide combinations that can exist within a crystal structure is limited, since silver iodide favors different crystal habits than that of silver bromide or chloride.

Figure 1:
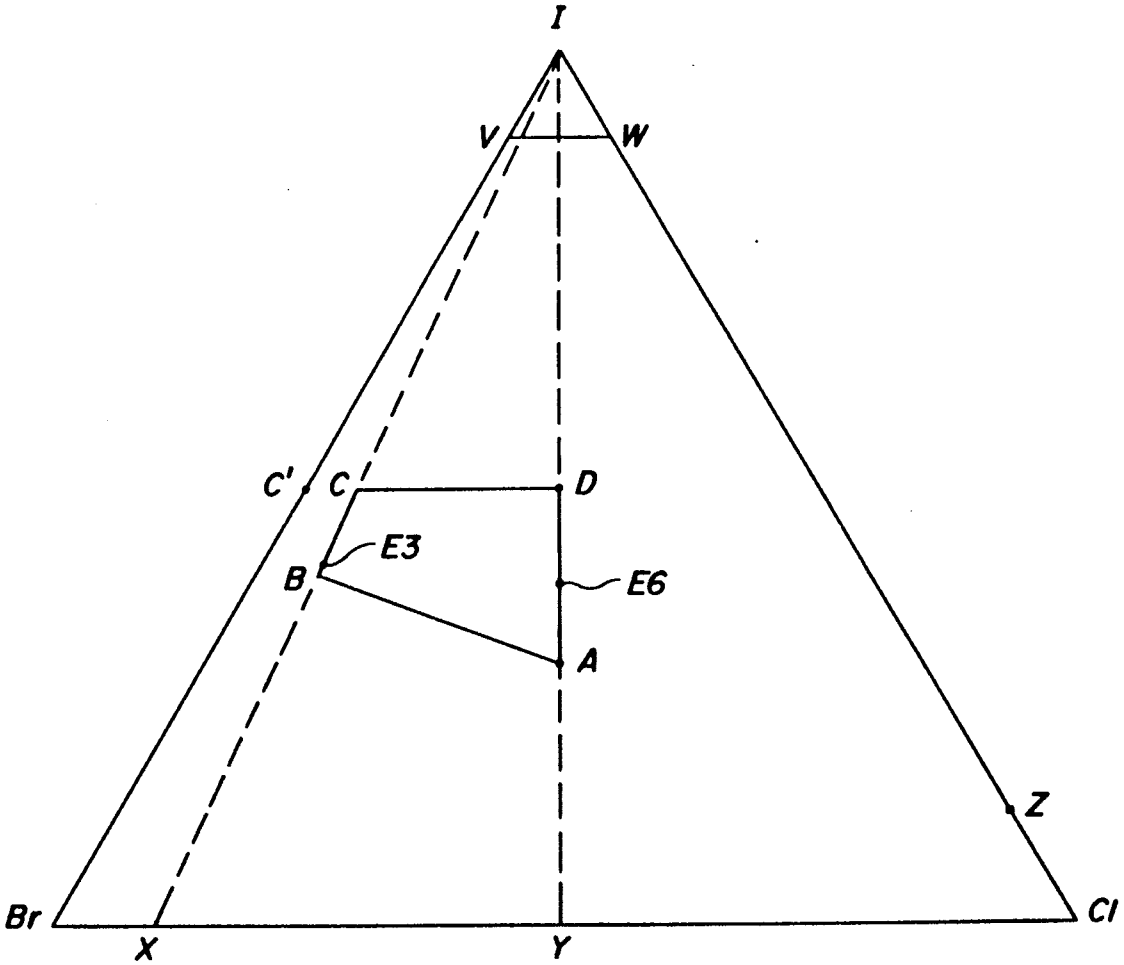
FIG. 1 is a matrix graphically illustrating all possible choices of any one or combination of chloride, bromide and iodide ions to satisfy a total halide requirement.

The range of conceivable combinations of iodide, bromide and chloride in a silver halide crystal structure as compared to those that can be realized is most readily visualized by reference to FIG. 1, which is a matrix encompassing all proportions of these three halides. Considering first only the extremes, at points I, Br and Cl 100% of the total halide is accounted for by the indicated halide. Along axis Cl-Br 0% of the total halide is accounted for by iodide. Along axis I-Cl 0% of the total halide is accounted for by bromide. Along axis Br-I 0% of the total halide is accounted for by chloride. At all other intermediate locations in the matrix a mixture of chloride, bromide and iodide is present, the concentration of each halide at any selected intermediate point being determined by the spacing of the intermediate point from the matrix 100% point and the 0% axis for that halide.

Silver chloride and silver bromide each form a face centered cubic rock salt type crystal lattice structure. These crystal structures are known which consist of silver ions and (a) bromide ions as the sole halide ions, (b) chloride ions as the sole halide ions, or (c) mixtures of chloride and bromide ions in all proportions. Thus, all possible combinations along the Br-Cl axis in FIG. 1 are known in silver halide grain structures. The crystal structures differ solely by their unit cell dimensions, which are a reflection of the differing sizes of chloride and bromide ions. Measurements of crystal lattice parameters are an accepted method of determining the ratio of halides present.

Silver iodide exhibits a face centered cubic rock salt crystal structure, but only at very high pressure levels (3,000 to 4,000 times atmospheric pressure). This form of silver iodide, referred to as $\sigma$ phase silver iodide, has no relevance to silver halide photography. A silver iodide crystal structure that is stable under ambient conditions is the hexagonal wurtzite type, commonly referred to as $\beta$ phase silver iodide. Another crystal structure of silver iodide sufficiently stable to be usable at room temperature is the face centered cubic zinc blend type, commonly referred to as $\gamma$ phase silver iodide. Silver iodide emulsions have been prepared containing each of $\beta$ phase and $\gamma$ phase crystal structures. A fourth crystallographic form of silver iodide is $\alpha$ phase, a body centered cubic crystal structure which is stated by James, *The Theory of Photographic Process*, 4th Ed., Macmillan (1977), page 1, to require a temperature of 146° C. for its formation. (James, pp. 1–5, are relevant to this and following portions of this discussion.)

In considering mixtures of bromide and/or chloride ions with iodide ions in a silver halide grain crystal structure, there are two possible conditions to consider: (1) how much bromide and/or chloride ion can be tolerated in a silver iodide crystal structure and (2) how much iodide ion can be tolerated in a silver bromide and/or chloride crystal structure. Emulsions satisfying (1) are typically referred to as "high iodide" silver halide emulsions, where the iodide content is typically stated to be at least 90 mole percent, based on total silver. Maternaghan U.S. Pat. No. 4,184,878 is illustrative of a high iodide silver halide emulsion. Since silver iodide emulsions have found limited photographic utility, very limited investigation of bromide and/or chloride ion containing variations have occurred. It is generally believed, however, that the silver iodide crystal structure will not tolerate the incorporation of more than 10 mole percent of bromide and/or chloride ion before the halides partition themselves in different phases. Referring to FIG. 1, high iodide silver halide crystal structures exist within the area defined by points W, V and I.

The overwhelming majority of iodide containing emulsions satisfy condition (2). The most extensively used photographic emulsions are silver iodobromide emulsions. All references to composite halide emulsions, grains and crystal structures follow the convention (refer to James, cited above, page 4) of naming the halides in their ascending order of concentration.

Since chloride ions are considerably smaller than bromide ions, the size disparity between chloride ions and iodide ions is much greater than that between bromide ions and iodide ions. It is therefore not surprising that lesser amounts of iodide ions can be tolerated in a silver chloride crystal structure than in a silver bromide crystal structure. Silver iodochloride emulsions are known. Investigation has revealed that the upper limit (demonstrated in Example 1 below) of iodide incorporation in a silver chloride crystal structure is 13 mole percent (shown in FIG. 1 as point Z), based on total silver, using conventional emulsion preparation techniques.

Each halide ion selection is known to impart particular photographic advantages. Although known and used for many years for selected photographic applications, the more rapid developability and the ecological advantages of silver halide emulsions containing significant chloride ion concentrations have provided an impetus for employing these emulsions over a broader range of photographic applications. In seeking to retain the art recognized advantages of silver iodobromide emulsions while in addition realizing advantages attributable to chloride ion incorporation, an advantageous balance in halide content can be struck by selecting high bromide chloride containing iodohalide emulsions. As employed herein the term "high bromide chloride containing silver iodohalide" as applied to emulsions, grains and crystal structures is herein defined to require that the concentration of the halide ions other than iodide ions exceed or at least equal the concentration of iodide ions and that the concentration of bromide ions exceed or at least equal the concentration of chloride ions. High bromide chloride containing silver iodohalide emulsions include silver chloroiodobromides, silver chlorobromoiodides and silver iodochlorobromides. Referring to FIG. 1, all of the silver halide compositions containing three halides in the area bounded by points Y, Br, C' and D satisfy the high bromide chloride containing silver iodohalide definition.

In considering the iodide content of high bromide chloride containing iodohalide emulsions investigations reported in the Examples below have revealed that the maximum iodide ion inclusion levels employing conventional emulsion preparation techniques are limited. Attempts to prepare high bromide chloride containing iodohalide emulsions with a 1:1 molar ratio of bromide to chloride ion by conventional techniques have revealed that a maximum of less than 30 mole percent iodide can be incorporated within the grain structure. When these attempts have been repeated, but with a 9:1 bromide to chloride molar ratio, maximum iodide ion incorporation levels have remained below 40 mole percent. Thus, it has been concluded that conventional high bromide chloride containing iodohalide grain structures heretofore available to the art have contained lower iodide concentrations than those indicated by axis A-B in FIG. 1.

SUMMARY OF THE INVENTION

It is an object of this invention to make available photographic emulsions containing high bromide chloride containing silver iodohalide grain structures in which the proportion of iodide is increased above levels that have heretofore been attainable by conventional emulsion preparation techniques.

In one aspect this invention is directed to a photographic silver halide emulsion comprised of a high bromide chloride containing silver iodohalide grain structure in which the proportions of chloride, bromide and iodide ions are chosen to lie within the boundary defined by A, B, C and D in FIG. 1.

DESCRIPTION OF PREFERRED EMBODIMENTS

The present invention is directed to photographic silver halide emulsions containing high bromide chloride containing iodohalide grain structures with significant levels of chloride ion and an increased proportion of iodide ion. The chloride ion levels are at least 10 mole percent based on bromide and chloride combined. Stated another way, the molar ratio of bromide ion to chloride ion is at most 9:1 and, by definition, at least 1:1.

The B-A axis in FIG. 1 lies just above the upper limit of iodide incorporation in a high bromide chloride containing silver iodohalide crystal structure prepared by conventional photographic emulsion preparation techniques. These limits were confirmed by emulsion preparations included in the Examples below for purposes of comparison. The highest iodide incorporation level achieved in a high bromide chloride containing silver iodohalide crystal structure having a 1:1 molar ratio of bromide to chloride (i.e., lying along axis Y-I in FIG. 1) employing conventional emulsion preparation techniques was 27.3 mole percent iodide, based on silver. In other words, the highest iodide concentration observed in a conventional grain structure lying on axis Y-I lies just below point A.

When investigations were shifted to high bromide chloride containing iodohalide emulsions having a 9:1 molar ratio of bromide to chloride, a series of grain structures were prepared lying along axis X-I in FIG. 1. These investigations revealed the conventional emulsion preparation techniques were limited to maximum iodide incorporation levels of less than 40 mole percent, based on total silver. As reported in the Examples below the highest incorporated iodide level in a grain structure lying on axis X-I prepared by a conventional emulsion preparation technique was 37 mole percent, based on total silver. In other words, the maximum iodide level was just below point B in FIG. 1 on axis X-I.

The present invention is directed to photographic silver halide emulsions comprised of a high bromide chloride containing silver iodohalide grain structures in which the proportions of chloride, bromide and iodide ions are chosen to lie within the boundary defined by A, B, C and D in FIG. 1. That is, the high bromide chloride containing silver iodohalide grain structures provided by this invention contain iodide concentrations above the maximum iodide incorporation levels in conventional high chloride iodohalide emulsion grain structures. The grain structures E3 on axis X-I and E6 on axis Y-I provide specific examples of emulsions satisfying the requirements of this invention satisfying the composition boundary requirements of this invention.

The discovery of how to increase the iodide concentration of a high bromide chloride containing iodohalide grain structure arose from postulating that the limits of iodide incorporation under conventional emulsion preparation conditions were the result of iodide reaching its saturation limit in the face centered cubic crystal lattice. It was then proposed that the iodide concentration could be increased if (1) conditions could be found that would permit the iodide saturation limit to be increased and (2) the excess iodide incorporated under these conditions did not separate out of the face centered cubic crystal structure upon return of the emulsion so produced to ambient conditions of handling and use. Whether condition (2) could be satisfied remained, of course, entirely speculative until an emulsion preparation satisfying condition (1) had been devised and demonstrated.

In considering how a higher silver iodide saturation level could be created in a face centered cubic crystal structure the problem was confronted that photographic silver iodohalide emulsions are prepared by running an aqueous silver salt into an aqueous dispersing medium which usually contains an organic hydrophilic colloid peptizer. Since the silver iodohalide grains formed during precipitation must remain dispersed, precipitation is necessarily limited to temperatures compatible with retaining a liquid phase dispersing medium. Because of the increasingly high vapor pressure of water on heating, a temperature of 90° C. constitutes an accepted practical upper limit for the preparation of silver halide emulsions in a well controlled and reproducible manner. Even if an emulsion preparation temperature could be increased to 100° C., the boiling point of water, iodide level extrapolations from workable temperatures suggested no significant increase in iodide levels.

A preparation procedure was therefore proposed that departed entirely from conventional photographic emulsion preparation techniques. It was proposed to use elevated pressures in combination with emulsion preparation temperatures above 130° C. It was postulated that elevated pressures alone would be ineffective and such elevated temperatures would be unattainable in the absence of an elevated pressure.

To achieve a temperature above 130° C. in preparing silver iodohalide emulsions a procedure was devised whereby (a) a silver chlorobromide emulsion lacking iodide and (b) a silver iodide emulsion having a mean size of less than 0.05 μm were prepared separately. Emulsions (a) and (b) were then blended, subjected to a pressure chosen to allow the blended emulsion to be heated above 130° C. without boiling, and allowed to Ostwald ripen under these conditions, resulting in high bromide chloride containing silver iodohalide grains being formed containing elevated iodide levels. In an alternative preparation approach all of the halide can be concurrently precipitated to produced a mixture of silver halide phases. This eliminates the blending step and achieves the result similar to that described above when heat and pressure are applied. It is specifically contemplated to apply heat and pressure to the emulsions while they are being transported. Thus, the emulsions of the invention are amenable to continuous preparation procedures.

In demonstrating the feasibility of the preparation process described above to increase the iodide content of a high bromide chloride containing silver iodohalide emulsion, the emulsion shown as E3 in FIG. 1 (Example 3 below) was prepared containing 41 mole percent iodide, based on total silver. This represented an increase of 4 mole percent iodide over the control emulsion located just below point B on the X-I axis in FIG. 1 (Example 2 below). In other words the iodide concentration in the silver chloroiodobromide emulsion was increased 11 percent. At equal molar concentrations of bromide and chloride ion, iodide incorporation levels were increased from 27.3 mole percent (below point A, FIG. 1) to 39.6 mole percent, based on silver, as shown at point E6 in FIG. 1 (Example 6 below). This was an iodide concentration increase of 45 percent.

The high bromide chloride containing silver iodohalide emulsions satisfying the requirements of this invention are viewed as proof that incorporation of silver iodide into a high bromide face centered cubic crystal lattice grain structure can be enhanced by undertaking incorporation under conditions of elevated temperature and pressure. While the investigations undertaken to date demonstrate the feasibility of the approach to achieving high bromide chloride containing iodohalide emulsions with increased iodide contents, they have provided no indication of any upper iodide incorporation limit. The reason for this is that investigations reported have had as their purpose to demonstrate feasibility rather than to optimize the preparation process. The preparation process was chosen as the simplest available approach for achieving grain growth at elevated temperatures and pressures. If the preparation process of the invention were modified so that silver halide was formed in situ from soluble halide and silver salts (analogous to the procedures used in batch single-jet and batch or continuous double-jet precipitations), silver iodide incorporation into the rock salt type face centered cubic crystal lattice host would be increased. Increasing precipitation temperatures and selecting peptizers specifically for enhanced thermal stability are other parameters considered capable of enhancing iodide incorporation levels.

Apart from the features specifically described as being essential to the practice of the invention, the high bromide chloride containing iodohalide emulsions and the processes of their preparation are compatible with conventional emulsions and processes for their preparation. Attention is directed to *Research Disclosure*, Vol. 308, December 1989, Item 308, 119, particularly Section I, Emulsion preparation and types and Section IX, Vehicles and vehicle extenders, the disclosure of which is here incorporated by reference. *Research Disclosure* is published by Kenneth Mason Publications, Ltd., Dudley Annex, 21a North Street, Emsworth, Hampshire P010 7DQ, England.

In the simplest form of the invention the novel grain structure of the invention is found in the majority if not each of the grains of an emulsion and extends more or less uniformly throughout each grain. However, it is recognized that the novel grain structure can alternatively form only a portion of a grain. For example, the novel grain structure can be formed in only a core or only a shell region of a grain. Additionally, it is recognized that it is common practice to blend emulsions of differing grain populations to tailor emulsions to specific photographic populations.

EXAMPLES

The invention can be better appreciated by reference to the following specific examples.

All x-ray powder diffraction patterns of the emulsions were made using $CuK_B$ radiation. Silicon powder was added to the emulsion sample so that the values of $2\theta$ could be corrected using an internal standard.

For a two component silver halide phase at room temperature (25° C.) the following equations can be used to calculate the cubic crystal lattice constant, a, needed to determine the halide composition from X-ray diffraction data:

$$a(BrCl) = 5.5502 + 0.002246[Br]$$

$$a(ICl) = 5.5502 + 0.00635[I]$$

$$a(IBr) = 5.7748 + 0.00363[I]$$

where [Br] and [I] represent the concentrations of bromide and iodide, respectively, in mole percent. These equations appear in James, cited above, p. 4.

From these equations the following equation for a three component silver halide phase was derived:

$$a(IBrCl) = a(BrCl) + \frac{6.0844 - a(BrCl)}{84.12} \quad [I]$$

where a(IBrCl) is the lattice constant of the iodide containing face centered cubic crystal phase at room temperature and a(BrCl) is the lattice constant of an face centered cubic crystal phase of the same Br to Cl ratio as that of the iodide containing face centered cubic crystal phase, but lacking the iodide component.

EXAMPLE 1

Point Z, FIG. 1

This example is a control. It illustrates that only 12.8 mole % iodide can be incorporated in AgICl emulsion grains precipitated at 90° C.

To a stirred reaction vessel containing 400 ml of a solution 7.5% in bone gelatin and 0.1M in NaCl at 90° C. were added a solution 2.5M in $AgNO_3$ at 1 ml/min and a solution 2.025M in NaCl and 0.575M in NaI at a rate needed to maintain a pAg of 6.6. After 5 minutes, the rate of silver addition was linearly accelerated to 5.3 ml/min in 30 minutes. The total silver consumed was 0.25 mole.

If a single homogeneous phase had formed, it would be AgICl containing 23 mole % iodide. The x-ray powder diffraction pattern of the final emulsion showed the AgICl {420} reflection was centered at $2\theta=67.12°$ which calculates, from the equation given for a(ICl) given above, to be 12.8% in dissolved iodide. In addition, reflections attributed to free AgI were also observed.

When the procedure was repeated, but with increased iodide additions, mixed phases were observed. One phase, containing mixed halides, was of the composition obtained as the sole phase above. The other phase consisted essentially of silver iodide. From these observations it was concluded that the iodide concentration reported above was the maximum attainable under the conditions employed.

EXAMPLE 2

Below Point B, FIG. 1

This example is a control. It illustrates that a maximum of 37.1 mole % iodide can be incorporated in a 1:9 AgClBr crystal phase precipitated at 90° C.

To a stirred reaction vessel containing 400 g of a 7.5 wt % bone gelatin solution made 0.10M in chloride with NaCl was added $AgNO_3$ solution (2.5M) at 2.00 ml/min and a halide ion salt solution 0.325M in NaCl, 1.125M in NaBr and 1.25M in NaI at 2.00 ml/min. Note that the NaCl compound was in excess by an amount needed to maintain a constant 0.1M chloride ion excess in the reaction vessel. The volume of silver and halide solutions consumed were the same, and a total of 0.25 mole of silver was added.

If all of the iodide added went to form a single phase in the 1:9 AgClBr lattice, the phase would have been 50 mole % iodide, based on silver. X-ray diffraction analysis showed that two phases were formed. The major phase contained mixed halides. The mixed halide phase exhibited a {420} reflection of $2\theta=63.71°$, which demonstrated that the 1:9 AgClBr lattice additionally contained 37.1 mole % iodide. This phase was 6.3 mole % in chloride, 56.6 mole % in bromide and 37.1 mole % in iodide. The minor phase consisted essentially of silver iodide.

EXAMPLE 3

Point E3, FIG. 1

This example provides the preparation of an approximately 1:9 AgClBr emulsion containing an increased concentration of iodide. Specifically the crystal phase consisted of 5.9 mole % Cl, 53.0 mole % Br and 41.1 mole % I.

A fine grain emulsion containing the desired amounts of chloride, bromide and iodide, but consisting of multiple phases was prepared by the following procedure: To a stirred reaction vessel containing 4 L of an aqueous solution (10% in bone gelatin and 0.097M in NaCl) at 40° C. were added, at 150 ml/min each, a solution 4M in $AgNO_3$ and a solution 0.394M in NaCL, 1.80M in NaBr and 2.00M in NaI. The total silver and halide solutions consumed were 1.00 L.

A portion of this fine grain emulsion was placed in an autoclave and pressured to 689.5 kPa (100 psi) above ambient pressure with nitrogen. The emulsion was heated to 160° C. with stirring and held at this temperature for 5 minutes, then cooled to 40° C., which required 3 minutes.

The resulting emulsion consisted of grains having an average diameter of 0.9 μm. The X-ray powder diffraction pattern of this emulsion showed that two phases had formed. The minor phase consisted essentially of silver iodide. The major phase contained mixed halides. The mixed halide phase exhibited a {420} reflection at $2\theta=63.52°$, which indicated that that the 1:9 AgClBr lattice additionally contained 41.1 mole % iodide. More specifically the mixed halide lattice was 5.9 mole % in chloride, 53.0 mole % in bromide and 41.1 mole % in iodide.

Figure 2:
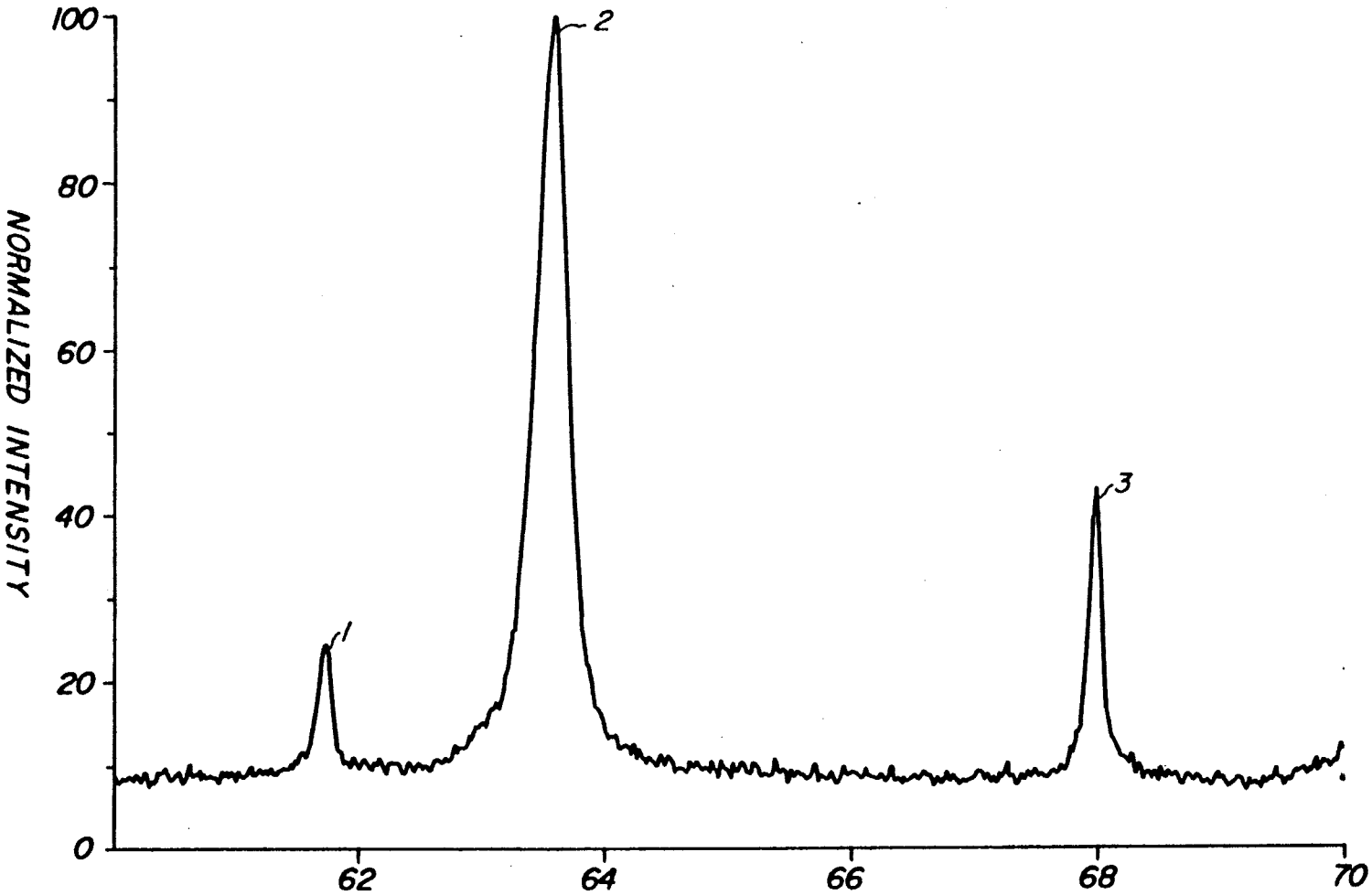
FIG. 2 is a plot of X-ray diffraction relative intensity versus scattering angle.

The X-ray powder diffraction pattern of the emulsion is shown in FIG. 2, where $2\theta$ is the scattering angle and the highest scattering intensity has been assigned a normalized value of 100. The peaks 1 and 3 are produced by a silicon internal standard. Peak 2 is the {420} reflection of the silver chloroiodobromide phase.

Figure 3:
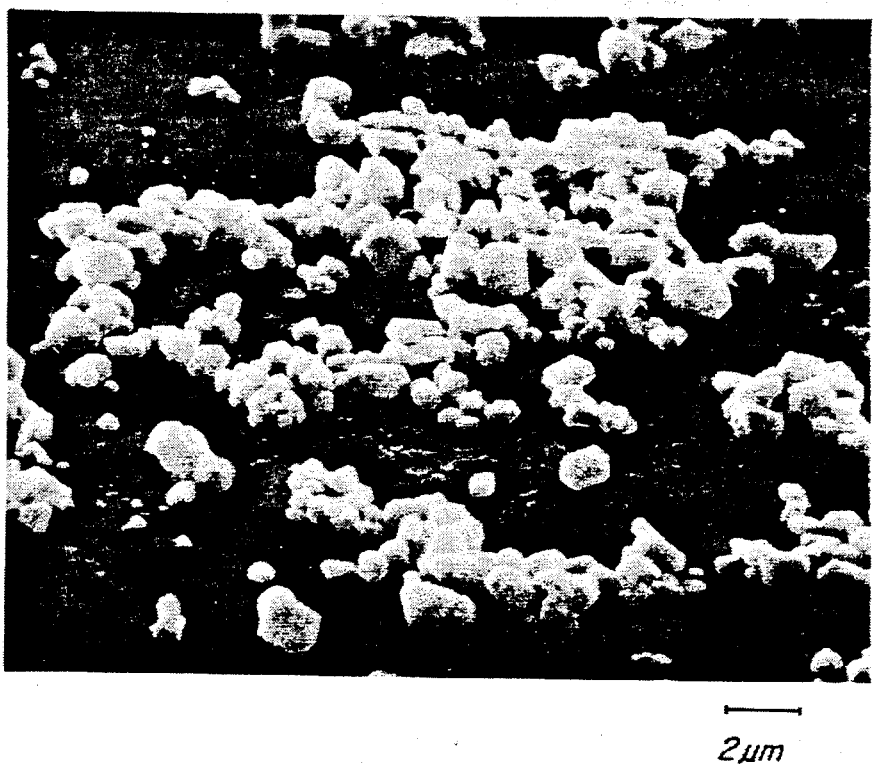
FIG. 3 is a scanning electron photomicrograph of the grains of an emulsion according to the invention.

FIG. 3 is a scanning electrode micrograph of the emulsion of this example.

EXAMPLE 4

Below Point A, FIG. 1

This example is a control. It illustrates that a maximum of 27.3 mole % iodide can be incorporated in a 1:1 AgClBr crystal phase precipitated at 90° C.

To a stirred reaction vessel containing 400 g of a 7.5 wt % bone gelatin solution made 0.10M in chloride with NaCl was added $AgNO_3$ solution (2.5M) at 2.0 ml/min and a halide ion salt solution at 2.0 ml/min. The composition of this halide ion solution is given in Table II below. Note that the NaCl compound was in excess by an amount needed to maintain a constant 0.1M chloride ion excess in the reaction vessel. The volume of silver and halide solutions consumed were the same, and a total of 0.25 mole of silver was added.

TABLE II

| Emulsion | 4A | 4B |
|---|---|---|
| Halide Ion Solution | | |
| NaCl | 1.07M | 0.95M |
| NaBr | 0.87M | 0.75M |
| NaI | 0.75M | 1.00M |
| Cl:Br:I Added (M %) | 35:35:30 | 30:30:40 |
| Scattering Angle $7\theta$ | 64.932° | 64.932° |
| Cl:Br:I Found (M %) | 36.4:36.4:27.3 | 36.4:36.4:27.3 |

X-ray powder diffraction analysis showed that Emulsion 4B contained two phases. One phase, containing mixed halides, was of the composition as the sole phase found in Emulsion 4A. The other phase consisted essentially of silver iodide. This analysis demonstrated that increasing the proportion of iodide present during precipitation is not capable of increasing the iodide concentration in the mixed halide phase.

EXAMPLE 5

This example gives the preparation of an AgBrClI emulsion which consists of one phase having a composition of 35.6 mole % I, 32.2 mole % Br and 32.2 mole % Cl.

A fine grain emulsion containing the desired amounts of chloride, bromide and iodide but consisting of multiple phases was prepared by the following procedure: To a stirred reaction vessel containing 4.00 L of a solution 10% in bond gelatin and 0.028M in NaCl at 40° C. were added a solution 4M in $AgNO_3$ at 150 ml/min and a solution 1.33M in NaCl, 1.30M in NaBr and 1.40M in NaI at a rate needed to maintain a pAg of 7.5. The total silver and halide solutions consumed were 1.00 L.

A portion of this fine grain emulsion was placed in an autoclave and pressured to 689.5 kPa (100 psi) above ambient with nitrogen. With stirring, it was heated to 160° C. and held at this temperature for 5 min. then cooled to 40° C. which required 3 min.

The resulting emulsion consisted of grains having an average diameter of 0.8 μm. The x-ray powder diffraction pattern of this emulsion showed the AgIBrCl (420) diffraction peak to be centered at $2\theta=64.42°$ which is appropriate for a composition of 35.6 mole % I, 32.2 mole % Br and 32.2 mole % Cl.

EXAMPLE 6

Point E6, FIG. 1

This example gives the preparation of an AgBrClI emulsion which consists of a main phase of a rock salt crystal structure having a composition of 30.2 mole % Br, 30.2 mole % Cl and 39.6 mole % I and a substantially smaller amount of a silver iodide phase.

A fine grain emulsion containing multiple phases having a combined composition of 27.5 mole % Cl, 27.5 mole % Br and 45.0 mole % I was prepared by the following procedure: To a stirred reaction vessel containing 4 L of a solution 10% in bone gelatin and 0.028M in NaCl at 40° C. were added a solution 4M in $AgNO_3$ at 150 ml/min and a solution 1.16M in NaCl, 1.10M in NaBr and 1.80M in NaI at a rate needed to maintain a pAg of 7.5. The total silver and halide solutions consumed were 1.00 L.

A portion of this fine grain emulsion was placed in an autoclave and pressured to 689.5 kPa (100 psi) above ambient with nitrogen. With stirring, it was heated to 160° and held at this temperature for 5 min. then cooled to 40° C., which required 3 min.

The resulting emulsion consisted of grains having an average diameter of 0.7 μm. The x-ray powder diffraction pattern of this emulsion showed that it consisted of a mixed halide phase of the rock salt type crystal structure and a smaller amount of a phase consisting essentially of silver iodide. The mixed halide phase exhibited a reflection at $2\theta=64.170°$ (full width at half peak height of 0.32°). With silver chloride and silver bromide confined to the mixed halide phase, the reflection angle indicated the mixed halide phase to consist of 30.2 mole % Cl, 30.2 mole % Br and 39.6 mole % iodide.

The invention has been described in detail with particular reference to preferred embodiments thereof, but it will be understood that variations and modifications can be effected within the spirit and scope of the invention.

What is claimed is:

1. A photographic silver halide emulsion comprised of a high bromide silver iodohalide grain structure having a face centered cubic rock salt type structure in which the proportions of chloride, bromide and iodide ions are chosen to lie within the boundary defined by A, B, C, and D in FIG. 1.

2. A photographic silver halide emulsion according to claim 1 in which said grain structure contains at least 40 mole percent iodide, based on silver.

3. A photographic silver halide emulsion according to claim 1 in which said grain structure contains a 9:1 molar ratio of bromide ion to chloride ion and from 40 to 50 mole percent iodide, based on silver.

4. A photographic silver halide emulsion according to claim 1 in which said grain structure contains a 1:1 molar ratio of bromide ion to chloride ion and from 30 to 50 mole percent iodide, based on silver.

5. A photographic silver halide emulsion comprised of a high bromide silver iodohalide grain structure having a face centered cubic rock salt type structure in which the proportions of chloride, bromide and iodide ions are chosen to lie within the boundary defined by A, B, E3 and E6 in FIG. 1.

* * * * *